United States Patent [19]

McDowell

[11] Patent Number: 4,942,682

[45] Date of Patent: Jul. 24, 1990

[54] DREDGING MODULE FOR USE WITH CONVENTIONAL BACK HOE APPARATUS

[75] Inventor: Alexander W. K. McDowell, Annapolis, Md.

[73] Assignee: Ellicott Machine Corporation, Baltimore, Md.

[21] Appl. No.: 379,194

[22] Filed: Jul. 13, 1989

[51] Int. Cl.[5] ..... E02F 3/32

[52] U.S. Cl. ..... 37/66; 37/68; 37/70; 37/94; 37/189; 414/723

[58] Field of Search ..... 37/64, 66, 68, 70, 77, 37/94, 189; 414/723

[56] References Cited

U.S. PATENT DOCUMENTS

| | | | |
|---|---|---|---|
| 2,801,479 | 8/1957 | Brauer | 37/66 X |
| 3,476,498 | 11/1969 | Von Bolhar | 37/66 X |
| 3,614,837 | 10/1971 | Araoka | 37/189 X |
| 4,639,183 | 1/1987 | Güthoff | 414/723 X |
| 4,646,449 | 3/1987 | Steinkühler et al. | 37/66 |
| 4,702,023 | 10/1987 | McDowell | 37/66 |

FOREIGN PATENT DOCUMENTS

| | | | |
|---|---|---|---|
| 2907485 | 9/1979 | Fed. Rep. of Germany | 37/66 |
| 546718 | 3/1977 | U.S.S.R. | 37/66 |

*Primary Examiner*—Randolph A. Reese
*Assistant Examiner*—Arlen L. Olsen
*Attorney, Agent, or Firm*—Scrivener and Clarke

[57] ABSTRACT

A self-contained dredging module includes a unitary body adapted to be attached to the stick of conventional back hoe apparatus to convert it with minimum modification from dry land to sub-aqueous excavation. The body carries a dual cutter wheel, suction pump, and separate motors for driving the cutter wheel and the pump. The cutter wheel is arranged on the module in such a position that dredging is permitted when the stick is moved in one direction and also permitted when the stick and module are turned upside down and the stick is moved in the opposite direction.

6 Claims, 4 Drawing Sheets

DREDGING MODULE FOR USE WITH CONVENTIONAL BACK HOE APPARATUS

This invention relates to dredges and more particularly to a dredge module releasably attachable to conventional back hoe apparatus normally intended for excavation exclusively on dry land.

Back hoe apparatus for dry land excavation is well known and comprises a crawler propelled chassis carrying a full revolving base pivotally supporting the inner end of a boom whose outer end pivotally supports a second boom known in the art as a "stick", the outer end of which pivotally supports a bucket normally facing the chassis. Hydraulic cylinders between the base and boom, the boom and stick and the stick and bucket, respectively, and also rotation means for the base, are actuated by an operator in a cab on the base to control the movement of the base, boom, stick and bucket during excavation.

The versatility of conventional back hoe apparatus can be increased by the provision of means for converting it from dry land excavation to sub-aqueous excavation, otherwise known as dredging. The problem with converting back hoe apparatus from dry land use to dredging lies in the desire, for economy reasons, to preserve the basic back hoe apparatus without having to resort to alterations so extensive that the original back hoe essentially disappears to re-emerge as a radically different dredge requiring a vast number of different components and a great many man hours to transform one type of apparatus into the other.

The broad object of the present invention, therefore, is to provide means whereby conventional back hoe apparatus, with substantially no change in its identity, may be readily and inexpensively converted from a dry land excavator to a sub-aqueous excavator i.e. a dredge, and vice versa.

More particularly it is an object of the invention to provide a self-contained module carrying the essential components required for dredging and which can be simply substituted at the end of a back hoe stick for the bucket normally carried in that position.

Still another object of the invention is not only to increase the versatility of conventional back hoe apparatus by the provision of a module for converting the back hoe to a dredge, but so arranging the module and the back hoe stick that together they can be turned upside down whereby dredging can take place either by forward movement of the module away from the back hoe apparatus, or by rearward movement of the module toward the apparatus.

Other objects and their attendant advantages will become apparent as the following detailed description is read in conjunction with the drawings wherein.

Figure 1:
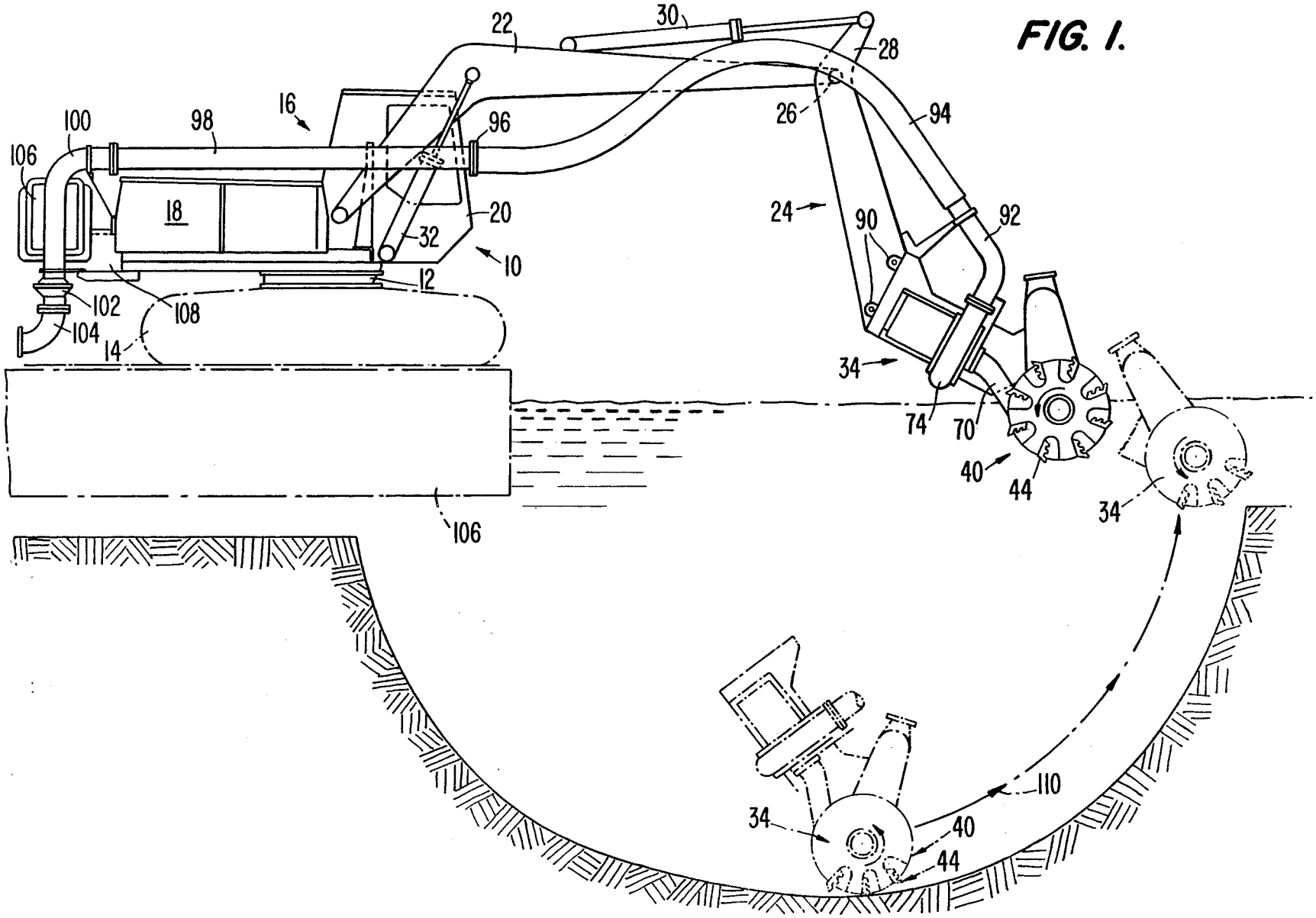
FIG. 1 is a schematic side elevational view showing the module of the invention connected to a stick of a conventional back hoe for dredging in a forward direction.

Referring now to the drawings and particularly FIG. 1, the numeral 10 refers generally to conventional back hoe apparatus comprising a chassis 12 mounted for propulsion on crawler treads 14. The chassis 12 carries a full-revolving base 16 having a power unit 18 such as a diesel engine, an operators cab 20, a boom 22 and a stick 24 which is pivotally connected at 26, near its outer end 28 to the boom 22. The end 28 of the stick extends beyond the pivot 26 to receive the end of a hydraulic cylinder 30 whose opposite end is connected to the boom. A second hydraulic cylinder 32 extends between the boom and back hoe base 16, the cylinders 30 and 32 being controlled by an operator in the cab 20 to actuate the boom and stick in a manner well known in the art.

What has been described so far is essentially conventional as it pertains to a back hoe excavator for dry land excavation.

Figure 2:
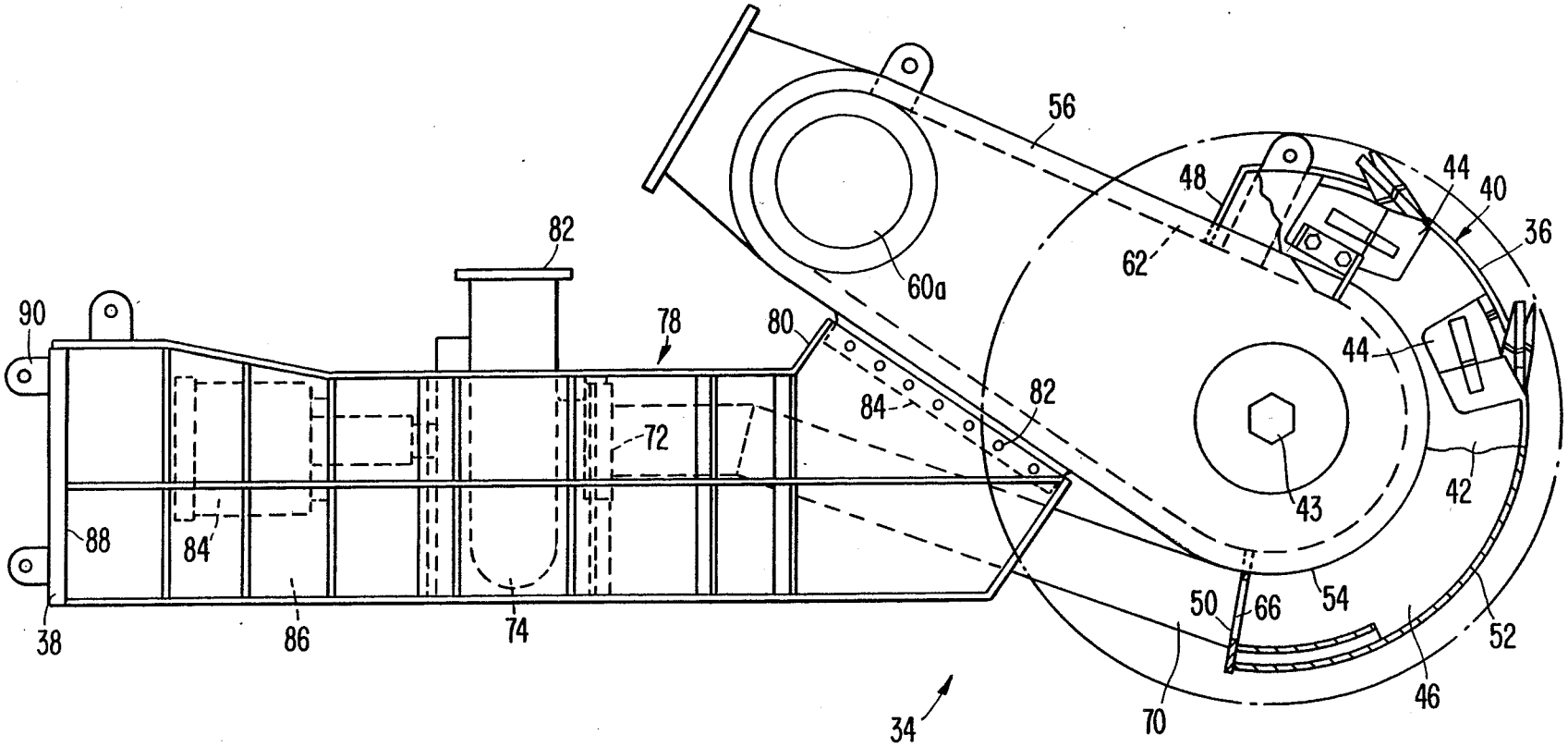
Fig. 2 is an enlarged side elevational view partly broken away of the module of FIG. 1.
Figure 3:
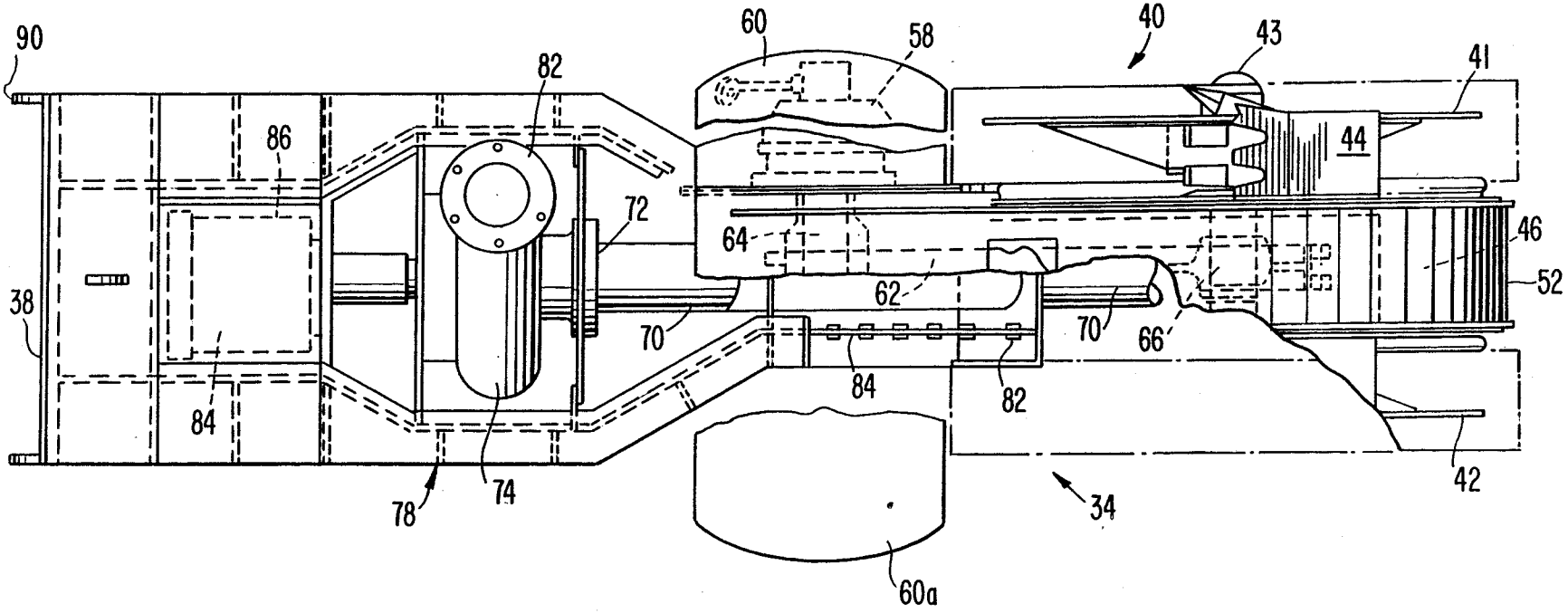
FIG. 3 is a top plan view, partly broken away of the module of FIG. 2.

The purpose of the present invention is to extend the range of usefulness of back hoe apparatus by the provision of a self-contained dredging module ÷ which can be releasably connected to the outer end of the back hoe stick in place of the conventional bucket. In accordance with the invention, and with particular reference to FIGS. 2 and 3, the module 34 comprises a rigid body having a front end 36 and a rear end 38. A cutter wheel 40 is rotatably supported at the front end of the body, the preferred cutter wheel being a dual wheel of the type shown, described and claimed in applicant's prior U.S. Pat. No. 4,702,023 which is assigned to the same assignee as the present application and to which reference is made for a description of details of the cutter wheel.

Generally, the dual cutter wheel comprises a pair of axially spaced plates 41, 42, mounted on a common horizontal axle 43 for rotation in unison. Scoops 44 are uniformly circumferentially spaced about the peripheries of the plates 41, 42 and, as described in the aforesaid patent, the scoops open axially inwardly to enable spoil in the scoops to flow axially inwardly through the open side walls of a hopper 46 defined between upper and lower radial end walls 48, 50, an arcuate outer wall 52 and an arcuate inner wall 54, which also defines an end wall for a sealed housing 56 for the drive for the dual bucket wheels. As described in the aforesaid patent, the drive preferably comprises a rotary hydraulic motor 58 hermetically sealed in a chamber 60 which opens into the housing 56 to permit a sprocket chain 62 to extend between sprockets on the output shaft 64 of motor 58 and on the cutter wheel shaft 43. The motor 58 is preferably a hydraulic motor receiving driving fluid as hereinafter explained. It may be desirable to provide a pair of hydraulic motors to drive the bucket wheel in which event a second motor (not shown) would be provided in the second half 60*a* of the chamber 60 shown in FIG. 3.

The lower radial end wall 50 of the hopper 46 has an opening 66 therethrough to receive the outer end of a suction pipe 70 whose inner end is connected to the inlet 72 of a suction pump 74 rigidly supported in a housing 78 whose outer end defines an elbow 80 which is rigidly fastened by bolts or rivets 82 to a flange 84 welded to the lower exterior surface of the housing 56. The pump 74 has an outlet 82 for connection with a dredge pipe as hereinafter described.

Figure 1A:
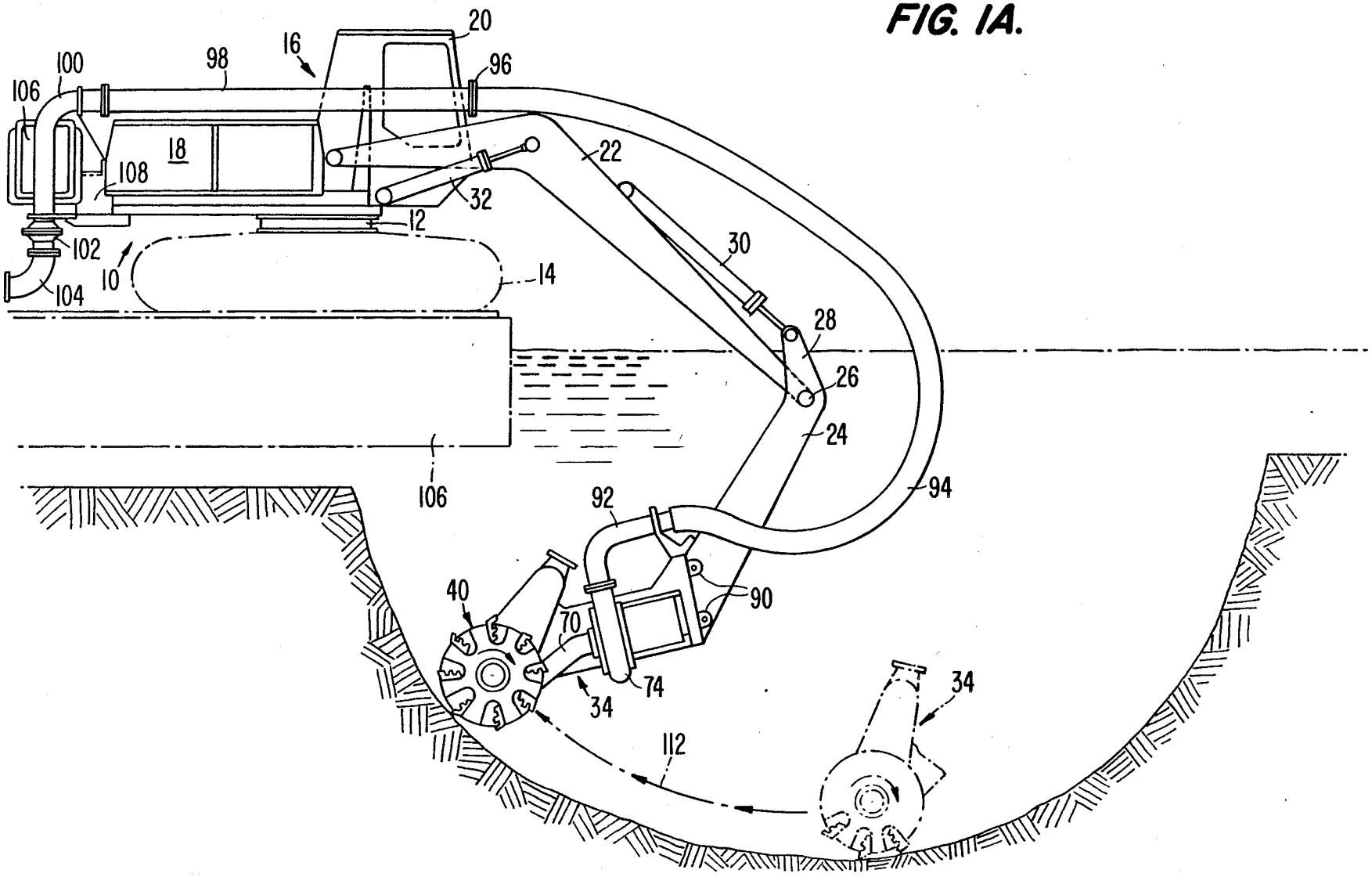
Fig. 1A is a schematic view similar to FIG. 1 showing the module of the invention connected to the stick of FIG. 1 but with the stick and module turned upside down from the position of FIG. 1 for dredging in a rearward direction.

The pump 74 is driven by a motor 84, preferably an hydraulic motor, mounted in a hermetically sealed chamber 86 in the housing 78. The housing 78 has an end wall 88 which may have welded thereto apertured ears 90 adapted to mate with openings on the outer end of a back hoe stick such as the stick 24 illustrated in FIGS. 1 and 1A. When so mounted the outlet 82 of the suction pump 74 is connected to a rigid elbow pipe 92 (FIGS. 1 and 1A), with flexible hosing 94 extending between it and a fitting 96 at the outer end of a rigid pipe 98 suitably supported on the base 16 of the back hoe apparatus. The rear end of pipe 98 is connected to an elbow 100 terminating in a ball joint 102 connected to an elbow 104 adapted to be connected to flexible hosing (not shown) which, if the back hoe apparatus is supported on a barge 106, as shown, is arranged in flat loops on the deck of the barge to provide enough slack to permit the back hoe base to be swiveled to the extent necessary for purposes of dredging. If the apparatus is supported on land at the edge of a waterway being dredged, the flexible hose would be looped on the ground, in either case, the rear end of the flexible hose would be connected to conventional rigid dredge pipe leading to the place of deposit for the dredge spoil.

As previously mentioned, the motors 58 and 84 for driving the cutter wheel 40 and pump 74, respectively, are preferably rotary hydraulic motors which must receive driving fluid from some power source. Because the invention is intended primarily for use with conventional back hoe apparatus designed for dry land excavation exclusively, and with minimal alteration to such apparatus, it is presumed that such apparatus would not have the capability to supply the fluid power necessary to drive the motors on the dredging module. To this end therefore the invention contemplates the provision of a separate diesel hydraulic power unit 106 which may be mounted on suitable brackets 108 to the rear end of the back hoe base. Suitable feed and return hoses (not shown) may be connected to the hydraulic motors 58, 84 in a manner similar to that by which the conventional hydraulic cylinders are connected to the power source 18 of the back hoe apparatus.

In use, the usual back hoe bucket is removed and the module fastened to the end of the stick 24. The fastening means represented by the ears 90 are representative only and the module may be suitably modified to adapt it to connection with a conventional stick though it is within the purview of the invention to provide a separate stick which is identical to a conventional stick except that it may be specially configured at its lower end to have the module attached thereto, preferably releasably, but in any such event the stick would form a part of the invention. With the module rigidly fastened to the stick and the stick and module pivotally connected to the boom 22 in the orientation of FIG. 1, dredging is accomplished in the direction of the arrow 110 away from the back hoe apparatus, the bucket wheel being driven counter clockwise. Should it be desired to undercut the bottom on the same side of the waterway as that on which the barge and back hoe apparatus are located, it is a relatively simple matter to turn the stick 24 and attached module 34 upside down as a unit to the position shown in FIG. 1A so that the module is moved in the direction of the arrows 112 towards the apparatus with the bucket wheel now rotating clockwise.

There is a limitation on a back hoe when used for dry land excavation in that when used for front loading whereby the bucket opens away from the apparatus, the reach of the loaded bucket at the end of the extended boom and stick may become excessive and the moment arm formed thereby may cause the apparatus to pitch dangerously in the direction of the loaded bucket. It is for this reason that back hoes are almost always restricted to back loading. When a conventional back hoe is converted to dredging by use of the present invention, excessive reach of a loaded excavator, such as a bucket, is not a problem since dredge spoil, being suspended in through-flowing water adds substantially no weight to the end of the moment arm defined by the extended stick as shown, for example, in FIG. 1. The module is designed to be within the weight limit which the back hoe apparatus can withstand without tending to pitch in the direction of the module, the operator, of course, being expected to exercise due care to prevent any possibly dangerous overloading should the bucket wheel encounter especially dense or unyielding bottom material.

From the foregoing it can be seen that the invention further increases the versatility of conventional back hoe apparatus since it not only permits it to operate as a dredge but also, without any change except in the orientation of the stick and module to operate in both forward and rearward dredging.

It will be understood that during dredging, the operator swivels the base 16 of the apparatus to properly position the wheel for efficient dredging operation, the ability of the back hoe base to swivel taking the place of the need to change the angle of the barge and a ladder carried thereby by the use of anchors and spuds as is done conventionally with large dredges for use in waterways of considerable depth.

Having now described the invention, what is claimed is:

1. A dredging module for attachment to conventional back hoe apparatus of the type comprising a mobile chassis, a full revolving base, a boom having an inner end pivotally connected to said base, and power means for controlling said boom and base, said module comprising a unitary body having front and rear ends, a dredge cutter wheel rotatably supported at the front end of said body, a hopper carried by said body positioned to receive therein spoil dredged by said cutter wheel, a suction pump carried by said body, suction pipe means connecting said hopper to the inlet of said suction pump, said suction pump including outlet means for connection to a dredge pipe, first motive means carried by said body and operatively connected to said cutter wheel for driving the same, second motive means, separate from said first, carried by said body and operatively connected to said pump for driving the same, and means for releasably connecting said body to conventional back hoe apparatus, said releasable connecting means including means carried by said body for releasably connecting said body to a back hoe stick.

2. The dredging module of claim 1, wherein said releasable connecting means includes a back hoe stick.

3. The dredging module of claim 1, wherein said dredge cutter wheel is a bucket wheel.

4. The dredging module of claim 3, wherein said bucket wheel is a dual bucket wheel having a pair of axially spaced wheel parts rotatable about an axis transverse to the axis of said stick, said hopper being interposed between said wheel parts.

5. The dredging module of claim 3, in combination with conventional back hoe apparatus including a boom, said releasable connecting means including a releasable pivot interconnecting said boom and stick, said module being connected to said stick in a position to permit dredging when said stick is moved in one direction relative to said boom and also to permit dredging when said stick and module are turned upside down and said stick is moved in the opposite direction relative to said boom.

6. The dredging module of claim 1, including a hermetically sealed housing means carried by said body, said first and second motive means comprising rotary hydraulic motors enclosed within said housing means, a hydraulic power unit for delivering hydraulic power to said motors, and means for mounting said power unit on said back hoe apparatus separately from the power means thereof.

* * * * *